United States Patent [19]

Edgley et al.

[11] Patent Number: 4,915,647

[45] Date of Patent: Apr. 10, 1990

[54] WIRE TRAP SPEAKER TERMINAL

[75] Inventors: Richard R. Edgley, Elmhurst; Lawrence D. Kroeger, Burr Ridge; Daniel M. Palmieri, Bloomingdale, all of Ill.

[73] Assignee: Molex Incorporated, Lisle, Ill.

[21] Appl. No.: 294,623

[22] Filed: Jan. 9, 1989

[51] Int. Cl.[4] ..... H01R 4/24

[52] U.S. Cl. ..... 439/441; 29/857; 29/741

[58] Field of Search ..... 439/845, 849, 850, 436–441, 439/638, 650, 651, 733, 741, 751, 907, 828, 829; 29/868, 869, 857

[56] References Cited

U.S. PATENT DOCUMENTS

| | | | |
|---|---|---|---|
| 1,686,958 | 10/1928 | Caruso | 439/438 |
| 2,603,679 | 7/1952 | Pavlinetz | 439/438 |
| 2,713,668 | 7/1955 | Gibilisco | 439/438 |
| 3,139,318 | 6/1964 | Binder et al. | 439/907 |
| 3,644,872 | 2/1977 | Russo, Jr. | 439/907 |
| 4,029,384 | 6/1977 | Reinwell, Jr. | 439/828 |

FOREIGN PATENT DOCUMENTS

| | | | |
|---|---|---|---|
| 1447935 | 9/1976 | United Kingdom | 439/438 |

*Primary Examiner*—David Pirlot

*Attorney, Agent, or Firm*—Louis A. Hecht; Stephen Z. Weiss

[57] ABSTRACT

A stamped and formed, unitary, metal wire trap speaker terminal used in coupling a speaker wire extending from an audio speaker to a lead wire for an audio system of an entertainment appliance includes a base portion and a wire trap receiving portion. The base portion to which is coupled the speaker wire has wings or arms that are adapted to be wrapped about a thin, rectangularly shaped insulator that is affixed to a frame member of the audio speaker. The wire trap receiving portion extends from one edge of the base portion, preferably at an angle of about 150 degrees, and has a wire receiving cavity so that a stripped end portion of the lead wire may be inserted through a wire receiving or entry port having divergently extending wire guides to aid the assertion of the stripped end portion of the lead wire into the wire receiving cavity. A cam contact beam is formed from one of the walls forming the wire receiving cavity and obliquely extends into the wire receiving cavity. When the stripped conductor portion of the lead wire is inserted into the wire receiving cavity, the conductor is trapped or locked between the contact beam and an opposite wall of the wire receiving cavity resulting in the coupling of the conductor of the lead wire to the terminal and thereby to the speaker wire.

15 Claims, 4 Drawing Sheets

WIRE TRAP SPEAKER TERMINAL

BACKGROUND OF THE INVENTION

1. Field of the Invention

The present invention relates to a terminal for connecting wires from an audio speaker to lead wires from an audio system of an entertainment appliance and, more particularly, to a new and improved terminal having a wire trap or push-in contact portion for receiving a conductor portion of a lead wire that connects the audio speaker to the audio system of the entertainment appliance and a base portion for mounting the terminal on an insulator affixed to a frame portion of the speaker.

2. Description of the Prior Art

An audio speaker used in an entertainment appliance, such as a television or a stereo, tends to have a pair of speaker wires extending out from the speaker, each of which needs to be connected to an audio system of the entertainment appliance. In order to connect the speaker wires to the audio system of the entertainment appliance, the speaker wires are often soldered to a terminal mounted on an insulator that is affixed on a frame member of the speaker. The terminal may include a base portion for affixing the terminal to the insulator. In addition, male spade terminals extend from the base portion and are adapted to receive female spade terminals that are coupled to insulated lead wires that are connected to the audio system of the entertainment appliance.

In order to attach the female spade terminals to the lead wires, the insulation along a small end portion of the insulated lead wire needs to be stripped or removed to expose a small section of the conductor in the wire. The exposed conductor portion is connected to a crimp contact section of the female spade terminal by positioning the exposed conductor portion in a crimp barrel formed between opposed wings or arms of the crimp section. When the wings are crimped into contact with the conductor, the conductor is electrically connected to the terminal. A second set of wings or arms in the crimp section of the terminal may also be crimped onto an insulated portion of the lead wire to form a strain relief for the connection.

In connecting the lead wires to the female spade terminals, a portion of the insulation on the lead wires not only has to be stripped but also the wings or arms of the terminal must then be crimped onto the exposed conductor. Consequently, it would be advantageous to eliminate the necessity of crimping a female spade terminal to the lead wires used in entertainment appliances.

SUMMARY OF THE INVENTION

Accordingly, objects of the present invention are to provide a new and improved terminal for use in connecting audio system lead wires to an audio speaker in an entertainment appliance or the like; to provide a new and improved terminal for use with an audio speaker that has a wire trap terminal section adapted to receive a conductor portion of the lead wire and a base portion for mounting the terminal on an insulator affixed to a frame member of the audio speaker; and to provide a new and improved terminal that eliminates the need to crimp a terminal onto a lead wire used in an audio system of an entertainment appliance in order to connect the lead wire to the audio speaker.

In accordance with these and many other objects, an embodiment of the present invention comprises a stamped and formed metal terminal having a base portion and a wire trap receiving portion. The base portion has wings or arms that are adapted to wrap about a thin, rectangularly shaped insulator that is affixed to a frame member of an audio speaker. The base portion further includes a hole in which a speaker wire extending out from the speaker may be disposed in order that the speaker wire may be electrically connected to the terminal by soldering it to the base portion. The wire trap receiving portion extends from one edge of the base portion, preferably at an angle of about 150 degrees. The wire trap portion has a wire receiving cavity into which may be inserted through a wire receiving or entry port a stripped end portion of a speaker lead wire that extends to the audio system of the entertainment appliance. Wire guides divergently extend from opposed sides of the entry port end to assist in asserting the stripped end portion of the lead wire into the wire receiving cavity. A cam contact beam is formed from a wall of the wire trap portion of the terminal and obliquely extends into the wire receiving cavity. As a result, a clearance or opening is formed between a free end of the contact beam and an opposite wall of the wire trap portion. When the exposed conductor end portion of the lead wire is inserted through the wire entry port, the contact beam is deflected and the conductor is trapped or locked between the free end of the contact beam and the wall of the terminal resulting in the coupling of the conductor of the lead wire to the terminal and thereby to the speaker wire.

DESCRIPTION OF THE DRAWING

Many other objects and advantages of the present invention will become apparent from considering the following detailed description in conjunction with the drawing in which.

DESCRIPTION OF THE PREFERRED EMBODIMENT

Figure 1:
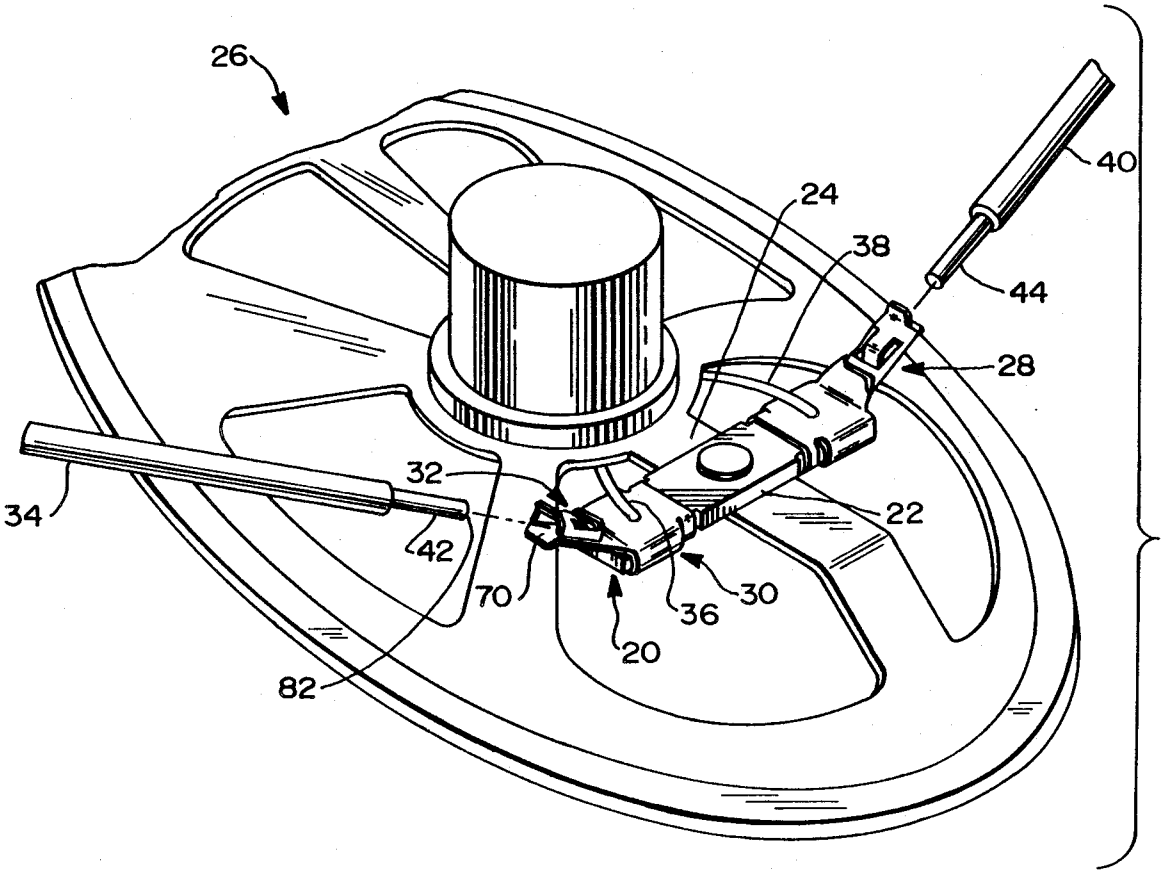
FIG. 1 is a perspective view of terminals embodying the present invention mounted on an insulator affixed to a frame member of an audio speaker.
Figure 4:
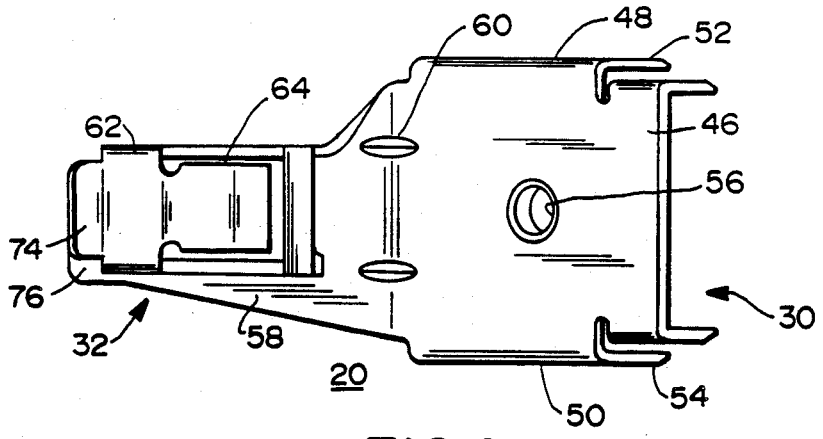
FIG. 4 is a top view of the terminal of FIG. 2.

Referring now more specifically to the drawing, therein is disclosed a wire trap speaker terminal which is generally designated by the numeral 20 and which embodies the present invention. The terminal 20 is shown in FIG. 1 mounted at one end of an insulator 22 which is secured to a frame member 24 of an audio speaker 26. A second terminal 28 is illustrated in FIG. 1 mounted on the other end of the insulator 22. The second terminal 28 is identical to the terminal 20 and hence any description of the terminal 20 is equally applicable to the terminal 28. As is shown in FIGS. 2–5, the terminal 20 is stamped and formed from a strip of metal and includes a base or mounting portion 30 that is adapted to affix the terminal 20 to the insulator 22 and a wire trap portion 32 that is adapted to receive a lead wire, such as lead wire 34, from an audio system of an entertainment appliance such as a television or stereo unit (not shown).

The speaker 26 may be of any standard configuration that is used in such entertainment appliances and as is the case with respect to most such speakers, the speaker 26 has a pair of conductors or wires 36 and 38 that need to be coupled to the audio system of the entertainment appliance by means of lead wires such as the lead wire 34 and a lead wire 40. In order to accomplish this connection between the wires 34 and 36, the speaker wire 36 is soldered to the base portion 30 of the terminal 20 and an exposed conductor portion 42 at an end of the lead wire 34 is inserted into the wire trap portion 32 of the terminal 20; and in order to accomplish the connection between the wires and 38 and 40, the speaker wire 38 is soldered to the base portion 32 of the terminal 28 and an exposed conductor portion 44 at an end of the lead wire 40 is inserted into the wire trap portion 32 of the terminal 28.

The insulator 22 is a standard type insulator used in conjunction with audio speakers such as the speaker 26. The insulator 22 is disposed on the frame member 24 of the speaker 26 and is adapted to receive the wire trap terminal 20 at one end and the wire trap terminal 28 at its other end.

The base portion 30 of the terminal 20 includes a generally flat base 46 from which extends along one edge a first set of opposed wings or arms 48 and 50 and from which extends along an opposite edge a second set of opposed wings or arms 52 and 54. As is illustrated in FIG. 1, the arms 48 and 52 are adapted to be bent so as to be wrapped about one edge of the insulator 22 and the opposed arms 50 and 54 are adapted to be bent so as to be wrapped about the opposite edge of the insulator 22. When the arms 48, 50, 52, and 54 are wrapped about the insulator 22 as illustrated in FIG. 1, the terminal 20 is secured to the insulator 22.

In order to couple the speaker wire 36 to the terminal 20, the speaker wire 36 is inserted into a hole 56 locate in the central portion of the base 46. Once the wire 36 is so positioned in the hole 56, the wire 36 may be soldered or otherwise connected to the base 46 of the terminal 20. In a similar manner, the wire 38 may be coupled to the terminal 28.

A bottom or support wall 58 of the wire trap portion 32 of the terminal 20 extends from a end 60 of the base 46. The other walls of the wire trap portion 32 include a top wall 62 and opposed side walls 64 and 66. The walls 58, 62, 64 and 66 may be formed from the same generally flat metal strip from which the base portion 30 is formed. Once formed into the configuration shown in the drawing, the walls 58, 62, 64 and 66 are maintained in that configuration by a tab 68 (FIG. 3) that extends from the side wall 64 through the bottom wall 58. The walls 62, 64 and 66 create a wire receiving cavity 70 in the wire trap portion 32 of the terminal 20. Access to the wire receiving cavity 70 is through a wire entry port 72 located at one end of the wire trap portion 32. A pair of divergently extending wire guides 74 and 76 are positioned on opposite sides of the wire entry port 72 to aid in inserting the conductor 42 into the wire receiving cavity 70.

Figure 2:
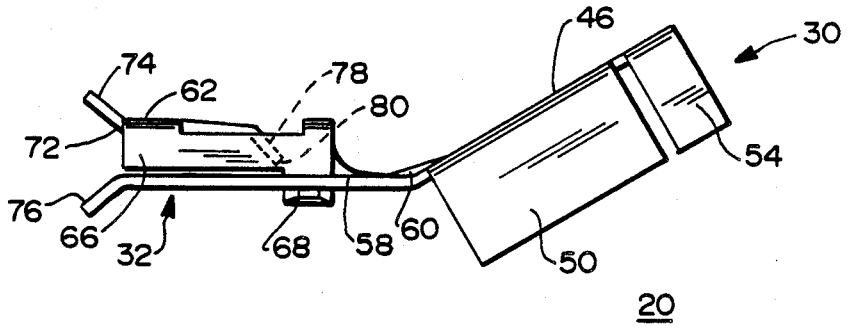
FIG. 2 is a side view of one of the terminals of FIG. 1.
Figure 3:
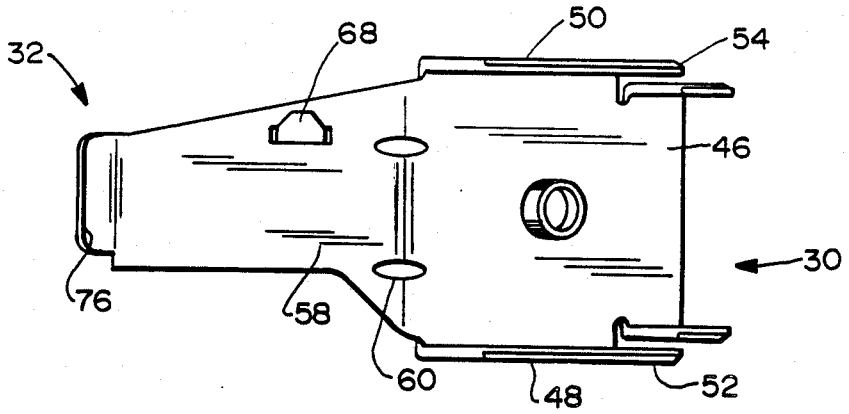
FIG. 3 is bottom view of the terminal of FIG. 2.
Figure 5:
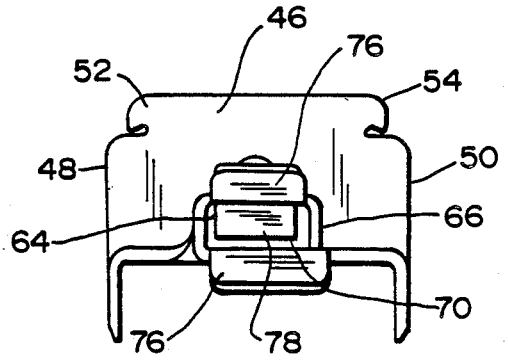
FIG. 5 is a end view of the terminal of FIG. 2.

As is best seen in FIGS. 1–2, the bottom wall 58 of the wire trap portion 32 extends from the base 46 of the mounting portion 30 at an obtuse angle. In the disclosed embodiment, the angle between the base 46 and the bottom wall 58 is approximately 150 degrees. The wire trap portion 32 projects at such an angle from the base portion 30 in order to allow the exposed conductor 42 to be more easily inserted into the wire receiving cavity 70.

A portion of the top wall 62 is stamped out from the top wall 62 in order to form a cam contact beam 78 that extends obliquely into the wire receiving cavity 70 from the top wall 62 toward the bottom wall 58. As a result, a free end 80 of the beam 78 is positioned adjacent to the bottom wall 58 of the wire trap terminal portion 32 and a small clearance is formed between the free end 80 of the beam 78 and the bottom wall 58. The clearance should be slightly smaller than the diameter of the conductor 42.

Figure 6:
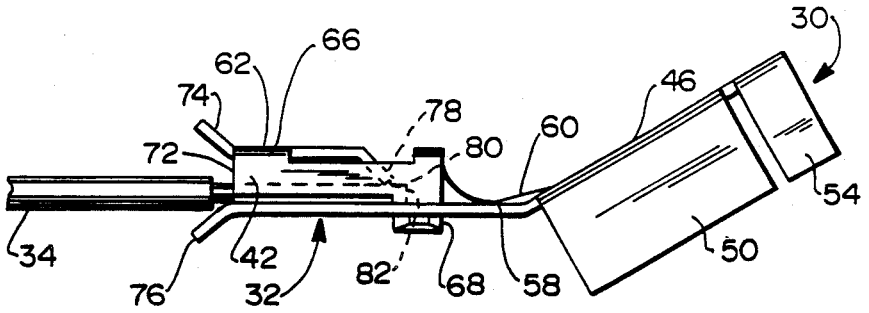
FIG. 6 is a view similar to FIG. 2 with a wire inserted into the wire trap portion of the terminal.

In order to secure the exposed conductor 42 in the wire trap portion 32 of the terminal 20, a portion of the outer insulation of the lead wire 34 needs to be removed as is illustrated in FIG. 1 of the drawing. The exposed conductor portion 42 is then positioned or inserted through the wire entry port 72 and into the wire receiving cavity 70 (FIG. 6). As the conductor 42 is extended further into the wire receiving cavity 70, an end 82 of the conductor 42 engages the free end 80 of the cam contact beam 78. Since the clearance between the free end 80 of the cam contact beam 78 and the bottom wall 58 of the wire trap portion 32 is less than the diameter of the conductor 42, the cam contact beam 78 is deflected slightly away from the bottom wall 58 of the wire trap portion 32. As the conductor 42 is inserted further into the wire receiving cavity 70, the force exerted by the resilience of the cam contact beam 78 against the conductor 42 secures or traps the conductor 42 in the wire receiving cavity 70. As a result, the conductor 42 is in electrical contact with the terminal 20 both through the engagement of the cam contact beam 78 with the conductor 42 and through the contact made by the conductor 42 being forced against the bottom wall 58.

Since both the conductor 42 and the speaker wire 36 are electrically connected to the terminal 20, the terminal 20 is a connector or interface between the speaker 26 and the audio system to which the lead wire 34 is coupled. In a similar manner, the terminal 28 is a connector or interface between the speaker wire 38 and the lead wire 40. These connections or interfaces are advantageously accomplished without the necessity of crimping or otherwise securing to the lead wire 34 any type of connector or the like. To the contrary, the stripping of a small portion of the insulation of the lead wires 34 and 40 to expose the conductors 42 and 44, respectively, is all that is required to make the connection of the lead wire 34 to the audio speaker 26.

While the invention has been described with reference to details of the illustrated embodiment, it should be understood that such details are not intended to limit the scope of the present invention as defined in the appended claims.

What is claimed and desired to be secured by Letters Patent of the United States is:

1. An electrical terminal for use in coupling a speaker wire for a speaker to an audio system lead wire having a conductor, said electrical terminal comprising:

a mounting means for mounting the terminal to the speaker, said speaker wire being coupled to said mounting means and said mounting means having a base portion from which extends arm means adapted to be bent so as to be mounted on an insulator affixed to said speaker; and a wire trap means extending from the mounting means, said wire trap means adapted to receive said conductor of said lead wire to couple said lead wire to said electrical terminal;

wherein said arm means includes a first pair of arms extending from one edge of said base portion and a second pair of arms extending from an opposite edge of said base portion, said first pair of arms being adapted to be wrapped bout an edge of an insulator secured to said speaker and said second pair of arms being adapted to be wrapped about an opposite edge of said insulator.

2. The electrical terminal as set forth in claim 2, wherein said wire trap means has a wire receiving cavity into which said conductor of said lead wire is inserted, said wire receiving cavity having a wire entry port with divergently extending wire guides to aid in the insertion of said conductor into said wire receiving cavity.

3. The electrical terminal as set forth in claim 5 wherein the terminal is stamped and formed from a generally flat strip of metal.

4. The electrical terminal as set forth in claim 1 wherein said wire trap means extends from said mounting means at an angle of approximately 150 degrees.

5. The electrical terminal as set forth in claim 1 wherein said wire trap means includes a wire receiving cavity and a cam contact beam extending obliquely into said wire receiving cavity from a first wall of said wire receiving means toward an opposite second wall of said wire receiving means such that a clearance is formed between a free end of said cam contact beam and said second wall.

6. The electrical terminal as set forth in claim 5 wherein said clearance that is formed between said free end of said cam contact beam and said second wall is coordinated with the size of said conductor of said lead wire.

7. The electrical terminal as set forth in claim 5 wherein said wire trap means is adapted to receive an end portion of said conductor such that the end portion of said conductor is trapped in said wire receiving cavity by being trapped between said free end of said cam contact beam and said second wall.

8. An electrical terminal for forming an electrical interface between a speaker wire of an audio speaker having an insulator mounted thereon and a stripped end conductor portion of a lead wire coupled to an audio system of an entertainment appliance, said electrical terminal comprising:

a wire trap portion having a wire receiving cavity with a cam contact beam in order to trap said stripped end conductor portion upon insertion of said end conductor portion into said wire receiving cavity; and a mounting portion to which is coupled said speaker wire and which is formed from said wire trap portion, said mounting portion having a first pair of arms extending from one edge of said insulator and a second pair of arms extending from an opposite edge of said insulator, said first pair of arms being adapted to be wrapped about an edge of said insulator secured to said speaker and said second pair of arms being adapted to be wrapped about an opposite edge of said insulator.

9. The electrical terminal as set forth in claim 9 wherein said wire receiving cavity has a wire receiving port through which said end conductor portion is inserted into said wire receiving cavity, said wire receiving port having opposed, divergently extending wire guides to aid in the insertion of the conductor portion through the wire receiving port.

10. The electrical terminal as set forth in claim 9 wherein said cam contact beam is formed from a wall of said wire receiving cavity and is resilient such that said cam contact beam is deflected as said end conductor portion is inserted into said wire receiving cavity and said end conductor portion thereby is trapped in said wire receiving cavity by said cam contact beam.

11. The electrical terminal as set forth in claim 9 wherein said mounting portion has a wire receiving hole for receiving said speaker wire in order that said speaker wire can be coupled to said mounting portion.

12. The electrical terminal as set forth in claim 8 wherein the wire trap portion and mounting portion of said electrical terminal are stamped and formed from a strip of metal to form a unitary terminal.

13. A method of coupling a lead wire having a conductor surrounded by insulation of an audio system to a speaker wire which extends from an audio speaker and which is coupled to a mounting means of an electrical terminal, said method comprising; 'stripping an end portion of said insulation from said lead wire to expose an end potion of said conductor;

inserting the exposed end portion of the conductor into a wire trap portion of said terminal to thereby couple said conductor to said speaker wire;

positioning a base of said mounting means on an insulator affixed to said speaker;

bending a first pair of wing means extending from one edge of said base about a side edge of said insulator secured to said speaker; and bending a second pair of wing means extending from an opposite edge of said base about an opposite side edge of said insulator to thereby secure said electrical terminal to said insulator.

14. An electrical terminal for use in coupling a speaker wire for a speaker to an audio system lead wire having a conductor, said electrical terminal comprising;

a mounting means for mounting the terminal to the speaker, said speaker wire being coupled to said mounting means and said mounting means having a base portion from which extends arm means adapted to be bent so as to be mounted on an insulator affixed to said speaker;

a wire trap means extending from the mounting means, said wire trap means adapted to receive conductor of said lead wire to couple said lead wire to said electrical terminal; and said insulator having portion cut out on opposite side edges;

wherein said arm means includes a first pair of arms from first opposite edges of said base portion and a second pair of arms extending from second opposite edges of said base portion, said first pair of arms being adapted to be wrapped about said first opposite edges of an insulator secured to said speaker and said second pair of arms being adapted to be wrapped about said cut out portions of said opposite edges of said insulator.

15. A method of coupling a lead wire having a conductor surrounded by insulation of an audio system to a speaker wire which extends from an audio speaker and which is coupled to a mounting means of an electrical terminal, said method comprising:

stripping an end portion of said insulation from said lead wire to expose an end portion of said conductor;

inserting the exposed end portion of the conductor into a wire trap portion of said terminal to thereby couple said conductor to said speaker wire;

positioning a base of said mounting means on an insulator affixed to said speaker, said insulator having portion cut out on opposite side edges;

bending a first pair of wing means extending from opposite edges of said base about opposite side edges of said insulator secured to said speaker; and bending a second pair of wing means extending from opposite edges of said base about said cut out portions of said opposite side edges of said insulator to thereby secure said electrical terminal to said insulator.

* * * * *